US005450655A

United States Patent [19]

Ferrari et al.

[11] Patent Number: 5,450,655

[45] Date of Patent: Sep. 19, 1995

[54] HINGE WITH ANTI-SHEAR DEVICE

[75] Inventors: Franco Ferrari, Frazione Deviscio, 2, 22053 Lecco; Carlo Migli, Lecco, both of Italy

[73] Assignee: Franco Ferrari, Lecco, Italy

[21] Appl. No.: 167,168

[22] Filed: Dec. 16, 1993

[30] Foreign Application Priority Data

Jan. 28, 1993 [IT] Italy ..... MI93U0064

[51] Int. Cl.[6] ..... E05D 15/32

[52] U.S. Cl. ..... 16/370; 16/368

[58] Field of Search ..... 16/366, 368, 369, 370, 16/250

[56] References Cited

U.S. PATENT DOCUMENTS 4,564,975 1/1986 Kuffner ..... 16/366
4,914,782 4/1990 Rupprechter ..... 16/370
5,058,238 10/1991 Lautenschlager ..... 16/370
5,062,182 11/1991 Griffiths et al. ..... 16/368

*Primary Examiner*—Mark Rosenbaum
*Assistant Examiner*—Chuck Y. Mah
*Attorney, Agent, or Firm*—Shlesinger Fitzsimmons Shlesinger

[57] ABSTRACT

A hinge (10) comprises a first (13) and a second (24) fastening element connected to each other by means of a kinematic articulated chain comprising at least two elements (18, 26) articulated to each other and defining space (28) between two of their opposing edges which varies in width upon rotation of the hinge. A further element (31) is secured to at least one of said two elements so as to be pushed by the rotating movement of the hinge to come to rest in correspondence with said space (28). In this way, the space is at least partially obstructed in order to prevent the transversal introduction of slender objects such as fingers.

11 Claims, 2 Drawing Sheets

HINGE WITH ANTI-SHEAR DEVICE

BACKGROUND OF THE INVENTION

This invention refers to an improvement to a furniture hinge of the type having a plurality of arms hinged to one another to form an articulated kinematic chain, which is disposed between an element, or base, to be secured to the furniture unit and an element, or cup, to be secured to the door. In particular, such a hinge can be of the known seven-pin type.

One of the problems of the known hinges with several pins is the problem caused by the empty spaces, in a crosswise direction with respect to the width of the hinge, existing between one component and the other. The dimensions of these spaces vary, even considerably, during the opening and closing of the hinge; and are a consequent danger for the fingers which can become accidentally trapped in the mechanism.

In the hinges of the known technique, attempts are made to minimize the maximum aperture left between one component and the other, by carefully designing the elements and the kinematic mechanism, and by providing for example wide side walls on the arms. This type of measure, however, has limits defined both by the kinematic mechanism of the hinge and by considerations of an economic and aesthetical nature. Due to the relative movements that the various elements must perform, there is obviously a reciprocal limit to the dimensions of these elements. Moreover, the greater the lateral extension is, then the need for material and the cost will increase proportionately, as will the negative aesthetical impression of excessive bulkiness. Consequently, in the hinges of known technique, and especially in the case of wide-opening hinges, there inevitably still remain dangerous gaps wide enough to accidentally trap the fingers.

The general scope of this invention is to obviate the aforementioned problems by providing a wide-opening multiple-pin hinge, which although being low in cost and having limited lateral dimensions of the movable parts, has obstructions to prevent the fingers from being inserted between said movable parts, so as to avoid any danger of shearing.

SUMMARY OF THE INVENTION

This scope is achieved, according to the invention, by providing a hinge comprising a first and a second fastening element connected to each other by means of a kinematic articulated chain comprising at least two elements articulated to each other and defining a space between two of their opposing edges which varies in width upon rotation of the hinge, characterized by the fact of comprising at least one further element secured to at least one of said two elements so as to be pushed by the rotating movement of the hinge to come to rest in correspondence with said space.

BRIEF DESCRIPTION OF THE DRAWINGS

The innovatory principles of this invention and its advantages with respect to the known technique will be more clearly evident from the following description of a possible exemplificative and non restrictive embodiment applying such principles, with reference to the accompanying drawings; in which.

DETAILED DESCRIPTION OF THE INVENTION

The figures show a hinge, made according to the invention and generically indicated by reference 10; comprising a plurality of articulated elements forming a kinematic chain or linkage disposed between a first fastening element or base 13 and a second fastening element or cup 24.

Figure 1:
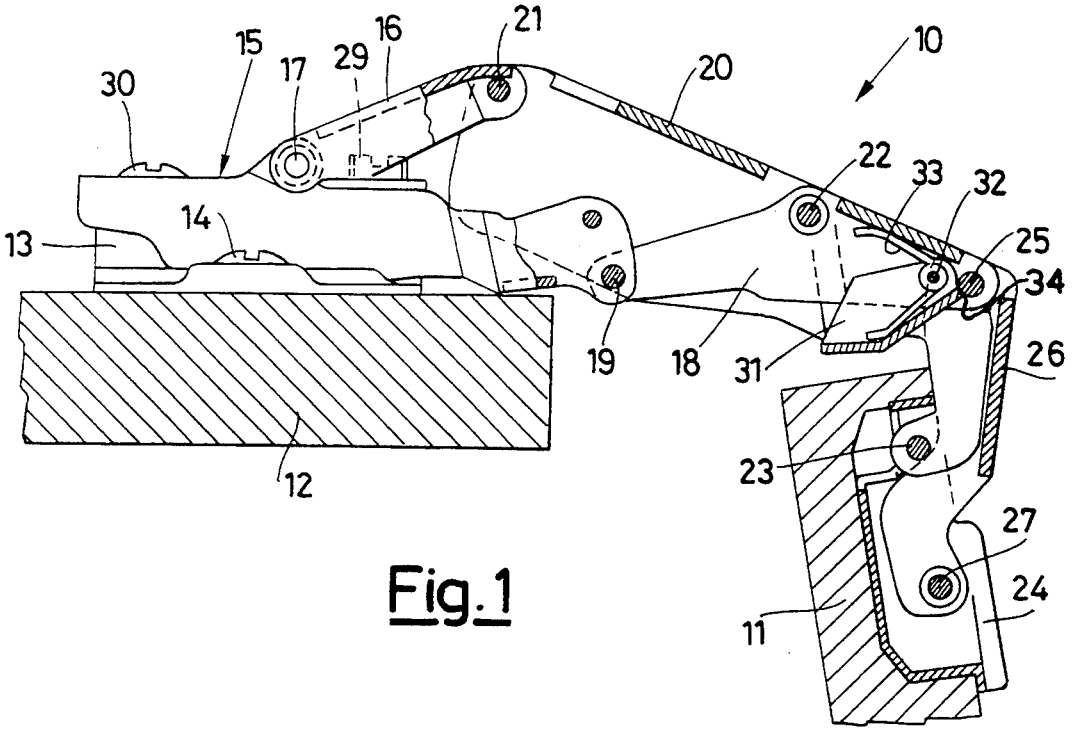
FIG. 1 shows a partial cutaway side view of a possible hinge according to the invention, in a position of maximum aperture.
Figure 4:
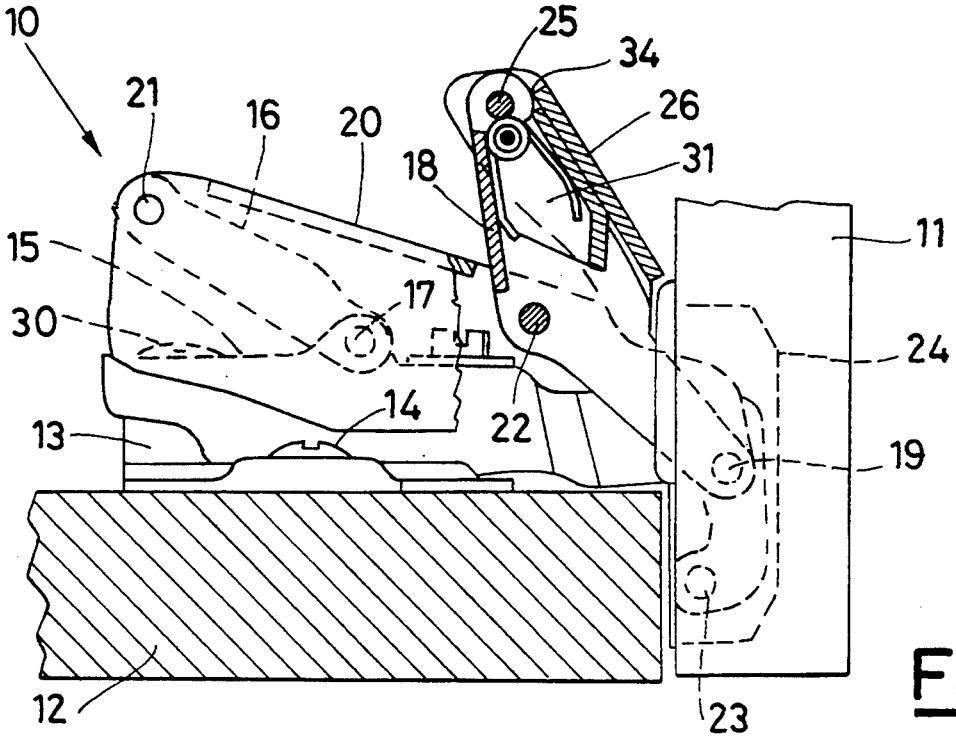
FIG. 4 shows a partial cutaway side view of the hinge of FIG. 1, in a closed position.

The hinge can be used for hinging a door 11 to the jamb of a furniture unit 12, so as to enable the door to move from a position of maximum aperture, shown in FIG. 1, to a closed position, shown in FIG. 4.

By way of example, as can be clearly seen in FIG. 1, the base 13 can be secured to the furniture unit 12 by means of screws 14 and is fitted with a wing 15, shaped in the form of an upturned U and secured to the base by means of screws 29, 30 to obtain a known position and height adjustment. The wing in turn supports the kinematic articulated chain ending inside the cup 24 which is recessed into a complementary compartment made in the door 11.

For example, the kinematic chain comprises a first element 16 having one end superiorly pivoted to the wing by means of a pivot 17, while a second element. 18 has one end frontally pivoted to the wing by meads of a pivot 19. A third element 20 is posteriorly pivoted, by means of a pivot 21, to the other end of the first element 16, and is centrally pivoted, with a pivot 22, in an intermediate position of the element 18, so as to form a first articulated quadrilateral. The element 20 extends beyond the pivot 22 and then curves towards the end to become pivoted, by means of a pivot 23, inside the cup 24. The end of the element 18 opposite the wing 15 is pivoted, by means of a pivot 25; to the end of a fourth element 26 which has its other end connected, by means of a pivot 27, to the inside of the cup 24, so as to form a second articulated quadrilateral.

The kinematic mechanism obtained enables the hinge to rotate to and from the open and closed position. It may also be provided with a spring device (not shown) to facilitate the movement towards the two extreme positions, as is known to the expert in the field. A device of this kind for example is described in the Italian utility model patent application N° MI91U000293.

The elements of the kinematic chain can be advantageously made with U-shaped cross-sections, for example by pressing them from sheet metal, in order to define lateral pivoting walls and transversal strengthening walls. As can be seen in FIG. 4, the U-shaped configuration enables the elements or pivoting arms to fit one inside the other when the hinge is completely folded.

Spaces are created between the opposing edges of the various elements which could constitute dangerous gaps through which the fingers could pass and be cut. In order to reduce this risk, the side walls of said elements are enlarged so as to reduce the free spaces laterally facing the hinge.

Figure 2:
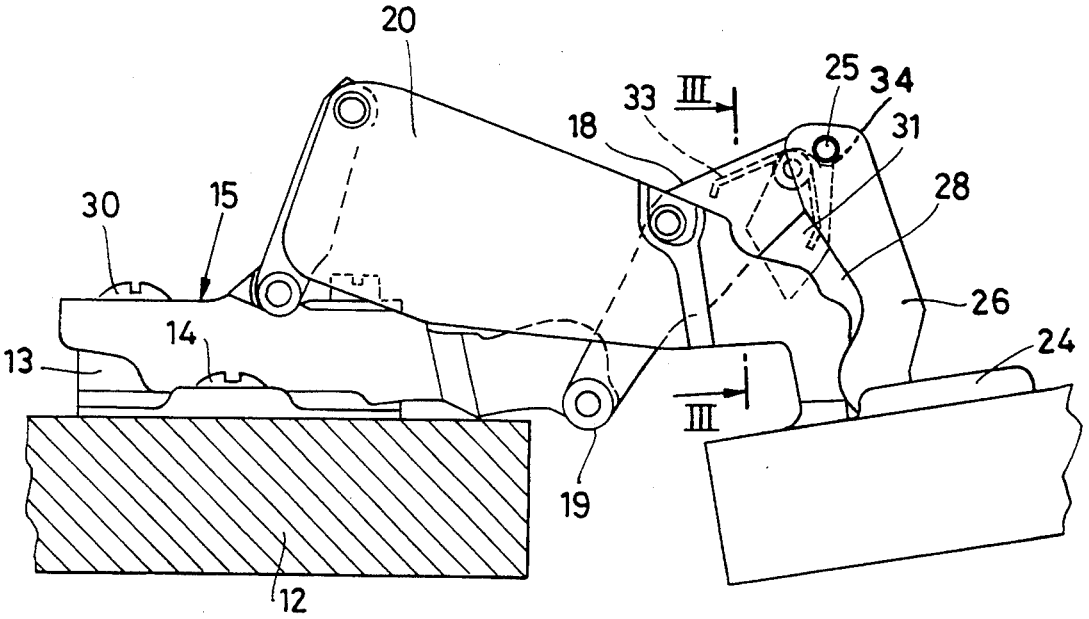
FIG. 2 shows a side view of the hinge of FIG. 1, in a position of intermediate aperture.

As can be seen in FIG. 2, the space formed by the first quadrilateral can be closed completely thanks to the wide side walls of the element 20. These walls are not excessively problematic in terms of aesthetics or overall dimensions since on closure of the hinge they are disposed to fit over the element 16 and, at least partially, the wing 15. Moreover, they help to strengthen the load bearing and relatively long element 20.

As can also be clearly seen in FIG. 2, in an intermediate opening condition, there is, however, a second space 28 which is formed between the opposing edges of the elements of the second quadrilateral. This space has a maximum aperture through which it is possible to introduce an object of limited diameter, such as for example the finger of a child.

With the known methods consisting of widening the side walls it is impossible to satisfactorily eliminate this danger. In fact, any increase in the walls of the elements in question would lead to interferences which would prevent the hinge from working properly.

According to this invention an innovative solution has thus been found which consists in disposing further elements or movable baffles to close the dangerous spaces, wherever necessary. These movable baffles are not required to fulfill any bearing function and can consequently be made of non-valuable and, consequently very inexpensive materials.

Figure 3:
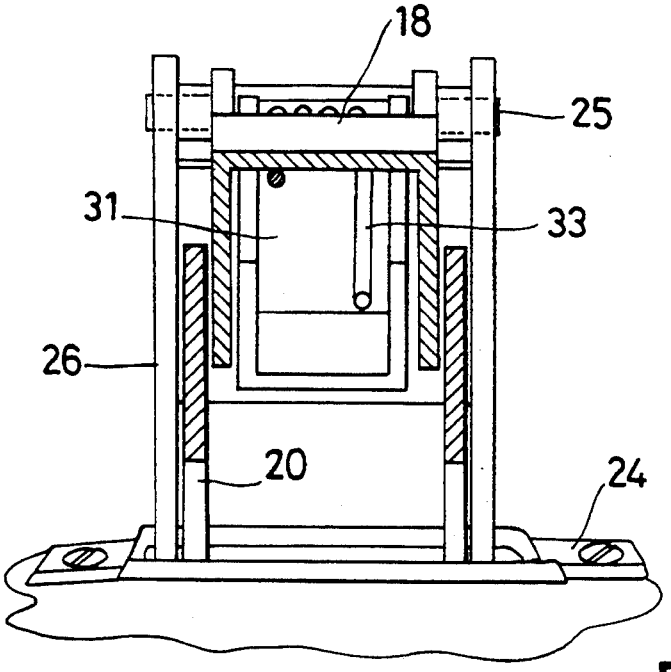
FIG. 3 shows a schematic view along the line III—III of FIG. 2.

In particular, the hinge given here as an example is provided with a pair of movable baffles disposed on both sides of the hinge in correspondence with the apertures leading into the space 28. The pair of baffles is advantageously made in the form of a single obturating element 31 with a generically U-shaped section and, as can be clearly seen in FIG. 3, with lateral walls forming the baffles close to the apertures leading into the passage 28.

The obturating element 31 is pivoted with a pivot 32 inside the element. 18 to enable it to be flexibly thrust towards the inside of the element. 18 against the action of a spring 33, advantageously wound, coaxial to the pivot. 32 and with arms reacting between element 18 and element 31. As can be seen in FIG. 4, the lateral profile of the element is made in such a way as to fit into the available space between element 18 and. 26 when the hinge is in the folded position. This space substantially coincides with the space inside the element. 18.

During the opening movement the baffle 31 is biased by the spring against the element 26, so as to obstruct the space 28 that is gradually created. When the hinge is open by a pre-established angle so that the baffle has come almost completely out of the element 18, stop members intervene to prevent continuation of the movement from causing the baffle to uncover a dangerous space between itself and the edge of the element 18.

As can be seen in FIGS. 1 and 2, these stop members can consist for example of one edge 34 of the element 31, which strikes against the pivot 25, The obturating element can be dimensioned in such a way that any possible small gap (visible in FIG. 2) remaining between it and the element 26 is not large enough to be dangerous.

As can be seen in FIG. 1, the position of the edge 34 and the size of the obturating element are such that when the hinge is fully open the obturating element does not interfere with the edge of the door. A slight interference would not however be harmful because it would occur in the direction of the yielding movement of the obturating element.

The spring 33 can halve a very low force since it is only required for holding the obturating element in place. The force of the spring consequently does not significantly interfere with the opening or closing force of the hinge. At this point it will be clear to the expert in the field how it has been possible to achieve the intended scope of providing hinges free from dangerous gaps for the fingers. It is obvious that the principles of this invention can also be readily applied to existing hinges by means of simple and inexpensive modifications, since they do not call for any alteration of the kinematic opening mechanism.

The foregoing description of an embodiment applying the innovatory principles of this invention are obviously given merely by way of example in order to illustrate such innovatory principles and should not therefore be understood as a limitation to the sphere of the invention claimed herein.

For example, the various elements may be of different shapes and sizes according to requirements, just as the kinematic mechanism for moving the hinge may differ. As can be easily imagined by the expert in the field, several movable baffles, according to the innovatory principles of the invention, may be used if necessary.

What is claimed is:

1. A hinge comprising first and second fastening members connected to each other by means of a kinematic articulated linkage comprising at least two lineage elements movably articulated to each other and defining between respective edges thereof a space which decreases in size upon movement of said respective edges of said two elements toward each other in response to rotation of the hinge in one direction, and characterized by the improvement comprising at least one further element mounted on at least one of said two elements so as to be pushed upon the rotating movement of the hinge in said one direction to a position of rest in which said further element is in correspondence with and overlies and substantially covers said space.

2. A hinge as claimed in claim 1, characterized by the fact that said further element is pivoted to said one of said two element and is biased by a spring toward said position of rest in correspondence with said space.

3. A hinge as claimed in claim 2, characterized by the fact that said one element to which the further element is pivoted is made with a generically U-shaped section having spaced side walls disposed to receive therebetween said further element during a movement of reciprocal approach of said respective edges the two said elements toward each other.

4. A hinge as claimed in claim 3, characterized by the fact that said further element comprises two side walls disposed parallel and close to the surfaces formed by said side walls of said one element to which it is pivoted.

5. A hinge as claimed in claim 4, characterized by the fact that said further element has a generically U-shaped section disposed to face in the opposite direction to the U-shaped section of said one element to which said further element is pivoted.

6. A hinge as claimed in claim 1, characterized by the fact that the first fastening member comprises a wing pivotally connected intermediate its ends to one end of a first element of said linkage by means of a first pivot, and having a second element of said linkage pivoted at one end thereof to one end of said wing by means of a second pivot, a third element of said linkage being pivoted at one end thereof by means of a third pivot to the other end of the first element, said third element being also intermediate its ends pivoted by means of a fourth pivot to the second element intermediate the ends thereof, the third element having its other end extending beyond the fourth pivot and being pivoted at said other end thereof by means of a fifth pivot to the second fastening member, the second element having its other end extending beyond the fourth pivot and at said other end thereof being pivoted by means of a sixth pivot to one end of a fourth element of said linkage, the other end of said fourth element being connected by means of a seventh pivot to the second fastening member.

7. A hinge as claimed in claim 6, characterized by the fact that the third element has spaced side walls for closing a space between the first element, the second element and the wing.

8. A hinge as claimed in claim 6, characterized by the fact that the first, the second, the third and the fourth elements are made of sheet metal bent into a generic U-shape.

9. A hinge as claimed in claim 1, characterized by the fact that the further element comprises stop members which halt its movement when a pre-determined rotation of the hinge is reached.

10. A hinge as claimed in claim 9, characterized by the fact that the stop members comprise an edge of the further element which interferes with a pivot of the elements of the kinematic linkage.

11. A hinge as claimed in claim 10, characterized by the fact that the pivot interfering with the edge is the sixth pivot.

* * * * *